United States Patent [19]

Froening et al.

[11] Patent Number: 4,483,121

[45] Date of Patent: Nov. 20, 1984

[54] ANCHOR CONSTRUCTION FOR CONCRETE WALLS OR SLABS

[75] Inventors: Helmut Froening; Mohamed Basyouni, both of Mannheim, Fed. Rep. of Germany

[73] Assignee: Hochtemperatur-Reaktorbau GmbH, Cologne, Fed. Rep. of Germany

[21] Appl. No.: 509,375

[22] Filed: Jun. 30, 1983

[30] Foreign Application Priority Data

Jul. 3, 1982 [DE] Fed. Rep. of Germany ..... 3224985

[51] Int. Cl.[3] ..... E04B 1/38

[52] U.S. Cl. ..... 52/698; 52/125.5

[58] Field of Search ..... 52/125.4, 125.5, 704, 52/698, 685, 686, 684, 679, 677

[56] References Cited

U.S. PATENT DOCUMENTS 2,772,560 12/1956 Neptune ..... 52/125.4 X
4,000,591 1/1977 Courtois ..... 52/698 X

FOREIGN PATENT DOCUMENTS 2223519 5/1972 Fed. Rep. of Germany ..... 52/125.4
1080793 8/1967 United Kingdom .

*Primary Examiner*—Carl D. Friedman
*Attorney, Agent, or Firm*—Schwartz, Jeffery, Schwaab, Mack, Blumenthal & Koch

[57] ABSTRACT

A concrete anchor is fixedly mounted in a reinforcing grid having a square mesh prior to the pouring of a concrete wall slab. A groove is formed on the concrete anchor between two flanges. The flange and the groove are laid out with respect to their dimensions so that the concrete anchor may be inserted in a mesh and fastened therein by rotation. A connecting nut is capable of being screwed into the concrete anchor. The connecting nut is movable while mounted in the concrete anchor enabling compensation for oblique positions with respect to the external surface of the concrete wall.

16 Claims, 5 Drawing Figures

FIG.1
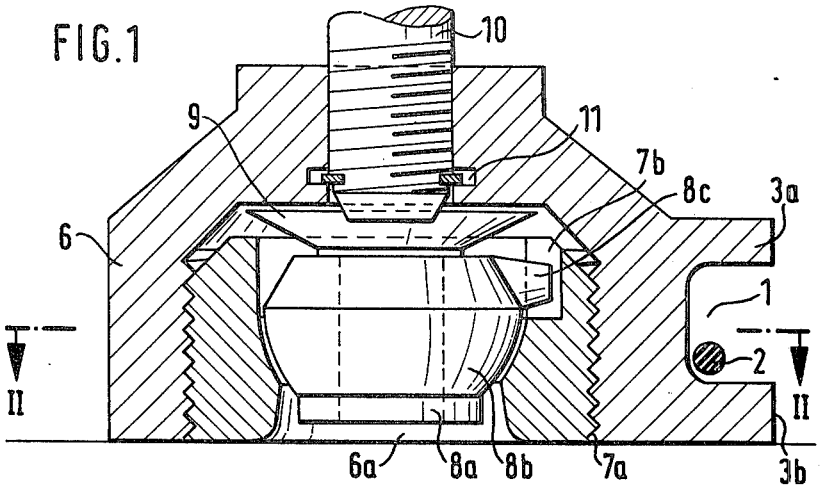
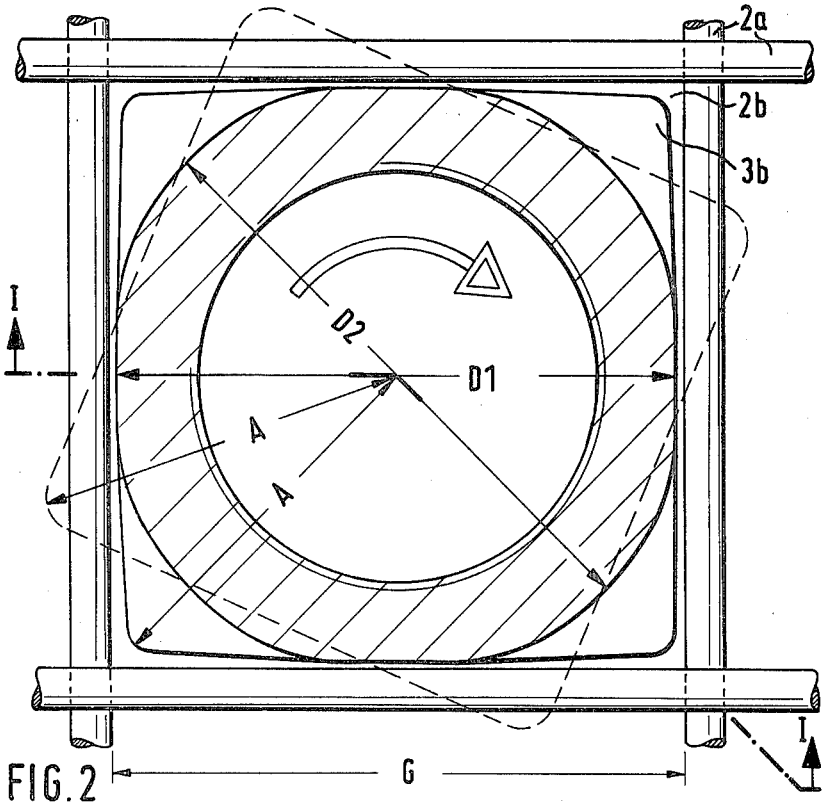
FIG.2

ANCHOR CONSTRUCTION FOR CONCRETE WALLS OR SLABS

BACKGROUND OF THE INVENTION

1. Field of the Invention

The invention concerns an anchor construction for use in concrete walls or slabs which enables the simple and convenient attachment of parts to the wall or slab without modification of the wall or slab itself.

2. Background of the Prior Art

In order to fasten parts of an assembly, for example, pipe lines, pumps, vessels, etc., at a certain distance from a concrete wall or slab, appropriate fastening parts are needed. A special problem is posed in this respect by the anchoring of the fastening elements in concrete itself. The fastening elements may be cast in the concrete during construction of the wall or slab or may typically be inserted subsequent to construction as dowels.

Anchoring with the aid of dowels is difficult in the case of nuclear reactor construction and particularly with steel reinforced concrete structural parts, due to the danger inherent with drilling into the reinforcement. A high expenditure of labor is required to safely avoid such damage.

In conventional operations the casting of anchors in the concrete at locations where they are subsequently needed requires very early planning. In spite of all the care taken, this does not always produce satisfactory results. The concrete anchors are often needed at a location other than that initially planned. Such difficulties have been eliminated in the prior art by means of a grid-like distribution of numerous concrete anchors over a large surface.

The grid-like distribution of concrete anchors as a function of the static load on a building wall is described in West German Offenlegungsschrift No. 2911157. The concrete anchor of this reference consists of screw sockets on both sides of a wall connected by means of a rod. The distance between the anchors is kept small so that pre-planning is not critical. The closest available concrete anchor may be used. Obvious disadvantages arise under this construction as the concrete anchors must be mounted prior to the pouring of the concrete into the concrete forms. Holes are typically drilled in the forms for the anchor members, making the forms restricted for reuse.

It is further known that concrete anchors can be installed in the concrete reinforcement itself prior to the pouring of the concrete wall. This is described in British Patent Specification No. 1,080,793. The anchor has a groove formed between two flanges which is engaged by the reinforcing rods. Exact placement of the anchors is, however, difficult in this arrangement as the standardizing effect of a predetermined grid is not utilized. Without such standardization, it is necessary to adapt the fastening elements in each individual case. This in general requires the high cost of intensive welding and cutting work at the site of the installation.

SUMMARY OF THE INVENTION

It is an object of the invention to provide an anchor construction for use in concrete walls or slabs and which includes an anchor which may be fastened easily to a welded reinforcing trellis that is mounted in a predetermined grid pattern. A high accuracy of the distances in the grid pattern and the cooperation of the anchoring orifice permits the fastening of parts to be mounted on the outside of the concrete wall without difficulty.

This and other objects are attained by the invention comprising a concrete anchor having a clamping member with an annular groove for connecting to the grid structure of a reinforcement in the concrete wall or slab. The specific configuration of the annular groove formed by two flanges makes the convenient insertion of the clamping member into any mesh of the reinforcing trellis. As the flanges are adapted to the square shape of mesh of the trellis, four "pairs of ears" are obtained, which upon the insertion of the clamping member to the reinforcing trellis, are facing the four corners of the mesh. The concrete anchor, therefore, may be inserted into a mesh of the trellis in one of four positions, offset by 90 with respect to each other. By rotating the clamping member in the mesh, the parts with a larger diameter of the annular groove are jammed against the slightly resilient rods, whereby a highly accurate fixation of the position of the concrete anchor is obtained. During the insertion of the clamping member the reinforcing mesh is not bent out of shape.

The ratio of the two diameters of the annular groove to each other is chosen so that a rotation of 10° to 45° is sufficient to obtain the clamping of the concrete anchor. If the concrete anchor is equipped with threads, the parts to be mounted may be simply screwed on.

The concrete anchor additionally comprises an anchoring orifice portion of the clamping member. This anchoring orifice may be tilted with respect to the external surface of the concrete wall as the result of slight movement during the course of pouring the concrete wall or slab. Thus, the tilting may occur in spite of the careful clamping of the concrete anchor in the reinforcing mesh. Such tilting actions may be compensated by the cooperation of a connecting nut with the anchoring orifice of the concrete anchor. The connecting nut is movable and makes possible the tilting of the connecting nut in all directions with respect to the surface of the concrete. In this manner, even pendulum movements of the parts connected may be compensated, for example, parts exposed to thermal expansion can still be safely mounted.

The concrete anchor construction according to the invention preferably utilizes the predetermined grid distribution of the concrete wall and thereby avoids a preliminary planning of the positions of the parts to be mounted. Many of the concrete anchors set into the concrete wall will thus be needed later on. For this reason, all of the concrete anchors or at least those not used, must be designed so that they may be produced at a low cost. Concrete anchors with a rotatingly supported connecting nut are relatively expensive. Such a configuration of the concrete anchor is required only in cases where the anchoring orifice is tilted, which must be compensated for. It is, therefore, advantageous to design the rotatingly supported connecting nut so that it may be installed after the construction, where needed. For this purpose, the concrete anchor comprises a clamping member which is fixedly inserted in the reinforcing mesh and cast in the concrete and a threaded insert equipped with the rotatingly supported connecting nut, which may be screwed into the clamping member.

A projection provided on the connecting nut and engaging a recess of the threaded insert prevents the rotation of the connecting nut in the screw direction. A spring washer is used to retain the laterally pivotable connecting nut in the position desired.

In order to further transfer into the concrete the anchoring forces acting perpendicularly on the concrete surface, the concrete anchor has an anchoring orifice located toward the inside of the concrete wall which again is provided with threads. A threaded rod screwed into the anchoring orifice at the end of which a second clamping or an anchoring plate is mounted, improves the anchoring action.

If the length of the threaded rod is adapted to the thickness of the wall or the slab and the anchoring orifice of the second clamping part is also accessible from the outside, a double anchor is obtained which may be utilized from either side of the wall or slab. Parts of the concrete anchor equipped with a bilateral anchoring orifice and with continuous threading are provided with at least one stop which snaps in during the screwing of the threaded rod and insures that no screw part penetrates deeper into the anchoring orifice than desired and which simultaneously prevents any subsequent unintentional unscrewing.

Prior to pouring, the concrete anchor is equipped with stoppers closing off its anchoring orifices, thereby preventing the penetration of the concrete pouring mass. The stoppers are adapted to the diameter of the individual anchoring orifice and may be removed after pouring. Their place is then taken by a threaded insert with the connecting nut.

If the concrete anchor is not tilted with respect to the external surface of the concrete body, a less expensive threaded reducer part may be inserted as the adapter part in place of a threaded insert with a connecting nut. In this manner, the relatively large threaded diameter of the clamping part is adapted to the smaller diameter for the parts to be mounted.

BRIEF DESCRIPTION OF THE DRAWINGS

Examples of the invention are represented in the drawings and shall be described in detail hereinafter.

In the drawings:

FIG. 1 shows a cross section along the line AA of FIG. 2 through a clamping member with the connecting nut inserted.

FIG. 2 shows the configuration of the annular groove of a clamping member inserted in the mesh of a reinforcing grid in the inserted position with the locking positions indicated along the section BB shown in FIG. 1.

DETAILED DESCRIPTION OF THE PREFERRED EMBODIMENTS

Figure 3:
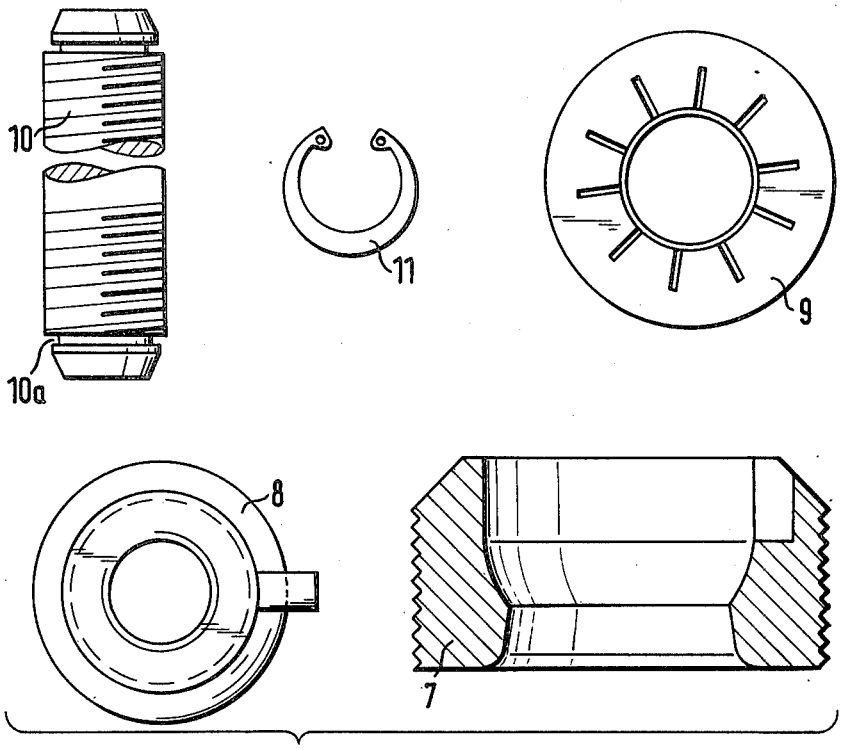
FIG. 3 shows individual parts of the concrete anchor construction.

In its simplest variant, the concrete anchor comprises only a clamping member which may be fastened in a mesh of the reinforcing grid by virtue of its particular configuration. The clamping member 6 shown in FIG. 1 has an annular groove 1 formed between two flanges 3*a*, 3*b*. As seen in FIG. 2, the flanges 3 are adapted in their cross section to the mesh of a reinforcing grid. The flanges are thereby given an ear-like configuration on the base body of the clamping member 6 and provide the latter with an approximately square cross section. As the cross section of the clamping member 6 is smaller than the area of the mesh, it may be inserted without difficulty in the correct portion of the mesh.

The annular groove 1 located between the flanges 3*a*, 3*b*, is designed with respect to its inner diameter so that it deviates from a circular configuration. While the diameters D1, perpendicular to each other, are equal to or smaller than the distance between two rods of the grid facing each other, the diameters D2, offset by 45° and again located perpendicularly to each other, are larger. The rotation of the clamping part in the mesh thus results in an increasing friction between the annular groove 1 and the rods 2*a* engaging it. The flange 3 prevents the lateral evasion of the clamping member 6 thereby providing a highly accurate positioning.

In spite of the careful insertion of the clamping member 6 into the mesh 2*b* of a reinforcing grid 2, the possibility of tilting of its anchoring orifice with respect to the surface of the concrete cannot be excluded, for example, during the pouring process. It is possible to compensate for such tilting by means of a connecting nut 8 inserted in a threaded insert 7 and movably supported therein. The insertion takes place prior to the screwing of the threaded insert into the clamping member. The connecting nut 8 has a spherical configuration in a partial area 8*b* and is resting in a cup-like recess of the threaded part 7. It may, therefore, be tilted into all directions while being secured against rotation by a projection 8*c* fitted into the recess 7*b*.

The connecting nut 8 has an anchoring orifice 8*a*, equipped with threads and serving the threaded connection of parts to be mounted outside the concrete wall. The spring washer 9 is provided to hold the connecting nut in the tilting position intended.

In a further development of the concrete anchor according to the invention, the clamping member 6 is connected by means of an anchoring orifice 6*b* and a threaded rod 10 with a second clamping member located on the opposite side.

Figure 5:
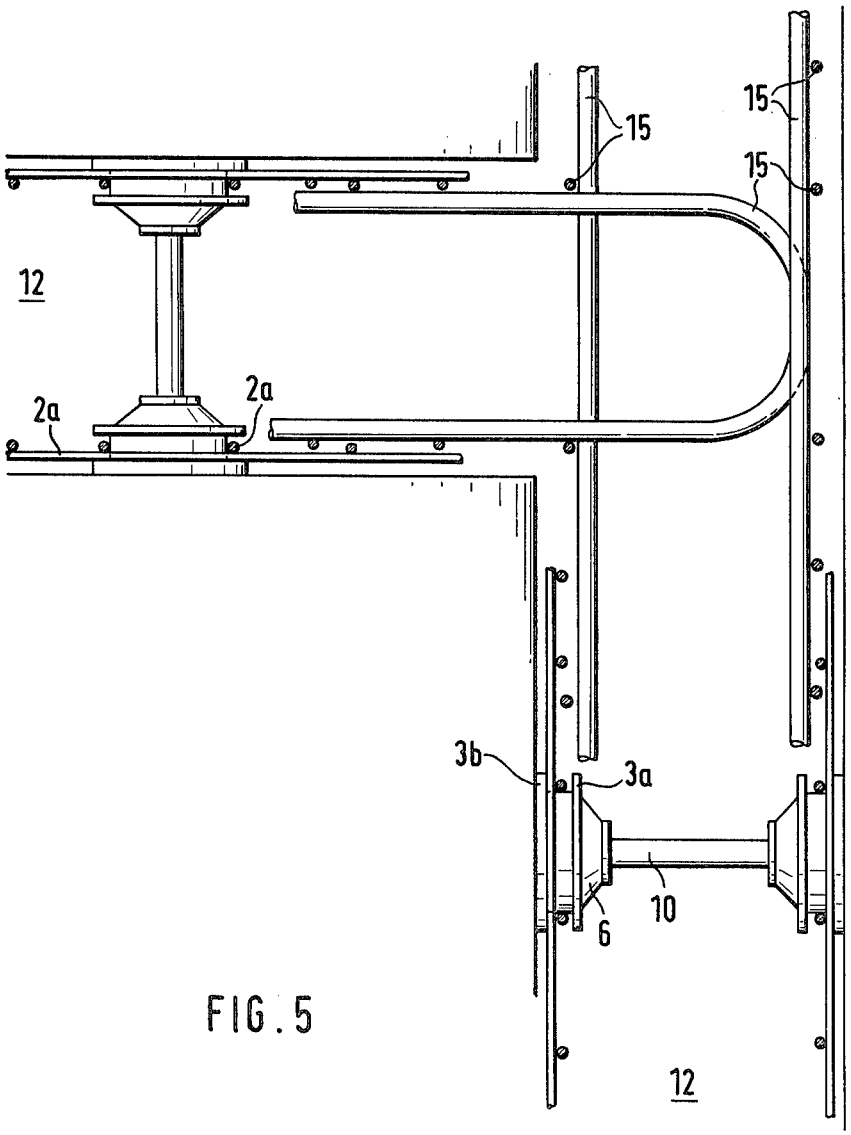
FIG. 5 illustrates a portion of a concrete wall and adjoining roof member with concrete anchors, reinforcing grids and the principal reinforcements.

FIG. 5 shows a concrete roof and wall 12 in which a clamping member 6 is cast in on either side. The two clamping members 6 are connected with each other by means of a threaded rod 10 and thus form a double anchor. In addition to the reinforcing rod 2 which primarily serves to hold the concrete anchors, the concrete body 12 further contains a principal reinforcement 15.

Figure 4:
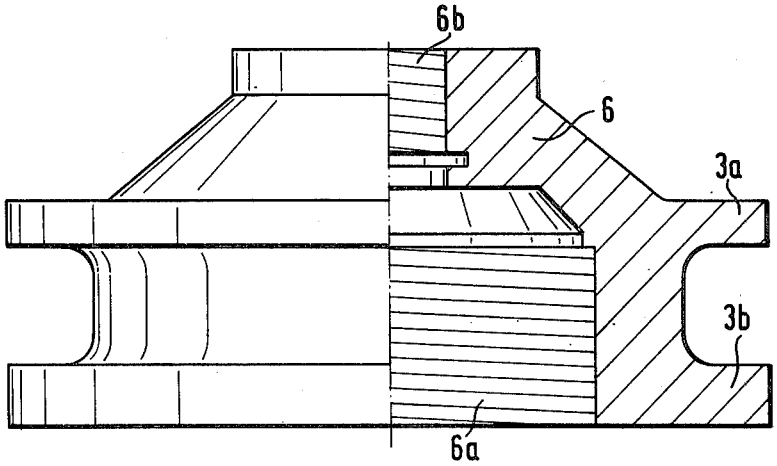
FIG. 4 illustrates a clamping member belonging to the concrete construction.

The individual parts belonging to one concrete anchor are shown in FIGS. 3 and 4. The concrete anchor consists of the clamping member 6, the threaded insert 7 to be screwed into the clamping part, the rotatingly supported threaded nut 8, the spring washer 9 holding the threaded nut in position, the threaded rod 10 and the snap ring 11 which engages the groove 10*a* of the threaded rod and connects it with the clamping member.

The construction as illustrated is most advantageously used for mounting internal structural members in nuclear reactors, especially reactors having concrete pressure vessels and even vessels with steel liners adjacent to the concrete walls. Examples of such nuclear reactors are well known. One such reactor is described in U.S. Pat. No. 4,175,001, the full disclosure of which is incorporated herein.

The above description describes a preferred embodiment of the invention. It is to be understood, however, that the invention is not limited to any single embodiment or feature, but should be constructed to cover all modifications and alternative embodiments falling within the scope of the invention as defined by the claims which follow.

What is claimed is:

1. An anchor construction for concrete walls or slabs comprising:

a reinforcing grid of reinforcing rods forming a uniform mesh cast in said concrete wall or slab, and at least one clamping member having a pair of flanges defining an annular groove, said clamping member being mounted in said reinforcing grid with the reinforcing rods in said annular groove, wherein a first inner diameter of said annular groove is less than or nearly equal to the inner distance of two adjacent, parallel reinforcing rods and a second inner diameter of said annular groove offset 45° from said first inner diameter is slightly larger than said inner distance and wherein said flanges defining said annular groove are essentially square shaped and slightly smaller than said inner distance and said second inner diameter is coincident with the corners of the square shaped flange.

2. An anchor construction of claim 1, wherein said clamping member is externally accessible for mounting parts to said concrete wall or slab.

3. An anchor construction of claim 1, wherein said reinforcing grid is a fixed, welded mesh of steel reinforcing rods.

4. An anchor construction of claim 1, wherein the ratio of said inner diameter of the annular groove provides the clamping of the clamping member after a rotation of 10° to 45°.

5. An anchor construction of claim 1 further comprising an anchoring orifice having a threaded portion in said clamping member.

6. An anchor construction of claim 5 further comprising a connecting nut rotatingly supported in said anchoring orifice.

7. An anchor construction of claim 6, wherein said connecting nut is threaded to receive members or parts for attachment to said concrete wall or slab.

8. An anchor construction of claim 6, wherein said clamping member is secured in the reinforcing grid and cast into the concrete wall and said anchoring orifice comprises an adapter part detachably connected to said clamping part and supporting said connecting nut.

9. An anchor construction of claim 8, wherein said adapter part is located within the concrete wall or slab and said clamping member has a bell-shaped configuration and said adapter part is in the form of a threaded insert.

10. An anchor construction of claim 9, wherein said connecting nut is equipped with a projection engaging a recess provided in said threaded insert.

11. An anchor construction of claim 10, wherein said connecting nut is held frictionally by means of a spring washer.

12. An anchor construction of claim 11 further comprising a second anchoring orifice located toward the internal side of the concrete wall or slab and a threaded rod attached to said second anchoring orifice at one end and at the other end attached to a second clamping member.

13. An anchor construction of claim 12, wherein said second clamping member is accessible from the outside on the other side of the concrete wall or slab.

14. An anchor construction of claim 13, wherein said adapter part is threaded and cooperates with the internal threading of the clamping member.

15. An anchor construction of claim 14 further comprising a snap ring in one of said anchoring orifices which prevents both the screwing-in to an excessive depth and a subsequent unintentional screwing-out of the part from the anchoring orifice.

16. An anchor construction of claim 15 further comprising removable plugs in said anchoring orifice for use during the pouring of concrete.

* * * * *